US011427431B2

(12) United States Patent
Barea

(10) Patent No.: US 11,427,431 B2
(45) Date of Patent: Aug. 30, 2022

(54) METHOD AND SYSTEM FOR FEEDING A TWISTED BRAIDED METAL CABLE OR FLAT WIRE FROM A CORRESPONDING SUPPORT WITHOUT ALTERING THE STRUCTURE OR SHAPE OF THE WIRE

(71) Applicant: BTSR INTERNATIONAL S.P.A., Olgiate Olona (IT)

(72) Inventor: Tiziano Barea, Busto Arsizio (IT)

(73) Assignee: BTSR INTERNATIONAL S.P.A., Olgiate Olona (IT)

( * ) Notice: Subject to any disclaimer, the term of this patent is extended or adjusted under 35 U.S.C. 154(b) by 177 days.

(21) Appl. No.: 16/633,606

(22) PCT Filed: Jul. 25, 2018

(86) PCT No.: PCT/IB2018/055544
§ 371 (c)(1),
(2) Date: Jan. 24, 2020

(87) PCT Pub. No.: WO2019/021204
PCT Pub. Date: Jan. 31, 2019

(65) Prior Publication Data

US 2020/0207571 A1 Jul. 2, 2020

(30) Foreign Application Priority Data

Jul. 27, 2017 (IT) ..... 102017000086095

(51) Int. Cl.
*B65H 59/38* (2006.01)
*B65H 49/20* (2006.01)

(52) U.S. Cl.
CPC ..... *B65H 59/387* (2013.01); *B65H 49/20* (2013.01); *B65H 59/388* (2013.01); *B65H 2701/36* (2013.01)

(58) Field of Classification Search
CPC .... B65H 59/387; B65H 59/388; B65H 49/20; B65H 57/18; B65H 57/22; B65H 57/26; B65H 2701/36
See application file for complete search history.

(56) References Cited

U.S. PATENT DOCUMENTS 3,275,264 A 9/1966 Crow
3,502,828 A 3/1970 Pestalozzi
(Continued)

FOREIGN PATENT DOCUMENTS

JP H02270773 A 11/1990
JP 2005262595 A 9/2005
(Continued)

OTHER PUBLICATIONS

International Search Report and Written Opinion dated Oct. 16, 2018 for PCT/IB2018/055544 to BTSR International S.P.A. filed Jul. 27, 2017.

*Primary Examiner* — William E Dondero
(74) *Attorney, Agent, or Firm* — Vorys, Sater, Seymour and Pease LLP

(57) ABSTRACT

Method and system for feeding a twisted metal cable braided into a plurality of braids or a flat wire from a support or spool to a winder or winding machine, including unwinding the cable or wire from the spool, measuring a property of the cable or wire from among its tension, velocity and quantity, possible adjustment of the property and feeding the cable or wire to the machine with the property constant. The cable or wire is unwound in a controlled way in a direction at right angles to the axis of the spool directly from such spool or through a return member which receives the cable or wire from the spool from which it is unwound in an uncontrolled way, such controlled unwinding preventing the cable changing the structure of its braids through loosening or stretching
(Continued)

and the wire undergoes torsion before its property is measured.

20 Claims, 5 Drawing Sheets

(56) References Cited

U.S. PATENT DOCUMENTS

| | | | | |
|---|---|---|---|---|
| 9,845,219 | B2 | 12/2017 | Barea | |
| 2015/0274482 | A1* | 10/2015 | Barea | B65H 59/388 242/418.1 |
| 2018/0002133 | A1* | 1/2018 | Stewart | D04B 35/14 |

FOREIGN PATENT DOCUMENTS

| | | | |
|---|---|---|---|
| WO | 9719014 | A1 | 5/1997 |
| WO | 2013064879 | A1 | 5/2013 |
| WO | 2013098631 | A1 | 7/2013 |

* cited by examiner

METHOD AND SYSTEM FOR FEEDING A TWISTED BRAIDED METAL CABLE OR FLAT WIRE FROM A CORRESPONDING SUPPORT WITHOUT ALTERING THE STRUCTURE OR SHAPE OF THE WIRE

CROSS-REFERENCE TO RELATED APPLICATIONS

This is a § 371 National Stage Application of International Application No. PCT/IB32018/055544 filed on Jul. 25, 2018, claiming the priority of Italian Patent Application No. 102017000086095 filed on Jul. 27, 2017.

FIELD OF THE INVENTION

The present invention relates to a method and system for feeding a twisted braided metal cable or flat wire to an operating machine which processes it, such as a winding machine or winder, according to the precharacterising clause of the principal claim.

BACKGROUND OF THE INVENTION

Twisted braided metal cables comprise a plurality of individual metal wires forming one or more braids, which may be subsequently braided together. These metal cables (having cross-sections of a few tenths of a millimetre up to several millimetres) are used in a wide variety of applications; in the present invention reference will be made to braided metal cables used to create electrical coils or transformers by winding cables around a metal or ferromagnetic core.

With reference to the metal cables mentioned above, a cable of this type is unwound or drawn from a spool and is fed to a winding machine or winder which positions it around the ferromagnetic core. The braided cable is fed with at least one of its properties such as tension, velocity and quantity of cable delivered held constant.

During the aforesaid feeding to the winding machine it has been found that the metal cable can lose its structural make-up, depending upon how a feed device drawing it off the spool or passing it to the winding machine (or "operating" machine) acts on the cable. For example, the individual wires making up the braid may come apart, destroying the structure of the braid, or the cable may be subjected to relatively high and in any event excessive feed tension such that the individual braided wires are further stretched and the cross-section of the braid is reduced.

This change in the structure of the cable braid may result in undesired effects on the coil obtained through its use and, in particular, on the electromagnetic properties of the coil or transformer.

This problem occurs as the spool empties.

In the case of a flat wire, there is a known problem associated with winding it onto the bobbin or spool supporting it: the wire tends to take up a helical shape, which can affect correct drawing-off by the operating machine using it, such as a winding machine.

Thus the technical problem to which the present invention relates is that associated with the change in the (physical and/or geometrical) structure of a braided cable or a flat wire wound from a corresponding support (spool, bobbin or the like) and fed to an operating machine such as a textile machine, a winding machine, a winder or the like. This change may take place through "loosening" of the cohesive force between the wires in the braid, or conversely in increased stretching of the braid (with a consequent reduction in the cross-section of the braid) or, in the case of flat wire, a change in the linearity and flatness of the wire, which takes up a helical shape.

The state of the art includes solutions relating to feeding metal wires unwound from corresponding spools to winding machines or winders, such as for example U.S. Pat. No. 3,275,264, which may also be provided with devices to control the tension in the wires, such as WO2013/064879 by the same Applicant. However, the problem pointed out above is not mentioned in these patents.

U.S. Pat. No. 3,502,828 describes an automatic rewinder for a twisted metal (copper) cable comprising a plurality of wires drawn from a first spool (pay-off spool) and wound onto a second spool (take-up spool). A detection station comprising means to keep the cable tension constant by taking up or relaxing the cable to obtain such constant tension is located between the two spools.

This detection station also comprises a detector device (comprising detector fingers) which can detect whether a wire is becoming detached from the cable while the cable is being transferred from the first spool to the second.

This device has a plurality of elements acting together with the moving cable and an electrical circuit which can detect whether a wire in the said cable is becoming detached. This occurs through contact between such wire and an aluminium block of such a detector device; as it moves the cable is held at an earth potential and if a wire that is becoming detached touches said aluminium block it creates an earth connection in the electric circuit.

This causes suitable relays present in the electrical circuit to be activated and a motor driving the second spool and braking the first spool to be switched off.

The solution described in U.S. Pat. No. 3,502,828 is therefore complex, also above all because a device to detect loosening of the metal cable that makes use of an electrical circuit, which is in any event of some complexity in both construction and use, is used.

In addition to this, the above-mentioned device described in U.S. Pat. No. 3,502,828 is an active device in the sense that it is able to act on the cable feed from the first spool to the second, immobilising it when loss of cable structure occurs.

Because of its complexity, the above-mentioned detector device is therefore also of more than negligible size, and this can also make it difficult to use in plants processing a large number of cables where such a device has to be used for each one.

U.S. Pat. No. 9,845,219 to Barea discloses a compact device for controlling the supply of a textile or metal thread to a processing machine, such as a textile machine or a spooling or winding machine, includes a body, at least one rotary member with which the thread cooperates, the member associated with a rotation velocity detector for detecting the rotation velocity thereof, the detector connected to a control unit, a tension detector provided for detecting the thread tension connected to such control unit. The rotary member is idle and is placed in rotation by the thread which is moved thereon, in proximity to such member the tension detector being placed. Also disclosed is a method for controlling the supply of thread actuated by such device.

WO 97/190414 and JP 2005262595 describe methods and devices for feeding a metal cable obtained by twisting a plurality of conducting wires together. These patents describe that tension is held constant while feeding takes place.

WO 2013/098631 describes a system for feeding a metal wire to an operating machine (100) through a wire feed at a desired tension detected by a tension sensor (25). The feed device has at least one rotating member which is driven by its own actuator onto which the metal wire is wound, over a fraction of a turn or several turns, and can feed the wire to the operating machine at the predetermined tension under the action of a control unit. This system comprises detector means for at least one physical property of the wire selected from tension, wire velocity and quantity of wire fed, located downstream from the feeder and connected to said control unit so as to provide the latter with data for each physical property detected. The control unit acts on the rotating member to control the tension of the wire to keep it at least close to a reference value for the monitored property of the wire.

This patent does neither discusses nor suggests how the problem of the change in the (physical and/or geometrical) structure of the metal wire as it is fed to the operating machine should be dealt with.

SUMMARY OF THE INVENTION

The object of the present invention is to provide a method and a system which, in view of the problem mentioned above, makes it possible for a braided metal wire or a flat wire to maintain its structure while being fed to an operating machine such as a winding machine or winder.

In particular, the object of the invention is to provide a method and a system of the above-mentioned type which are simple as regards detection and implementation and have a positive action on the feeding of such metal cable or flat wire to an operating machine.

Another object is that of providing a method and a system of the type mentioned, that is which make it possible to feed said braided cable or said flat wire to an operating machine of the said type while maintaining its structure and also holding at least one of the properties of the cable or wire, such as tension, feed velocity or quantity delivered at a constant value.

The Applicant has surprisingly found that the problem relating to the change in the structure of the metal cable formed by one or more braids of individual metal wires (for example of copper, a change which brings about loosening of the braid and consequent "detachment/loosening" of the cable or, on the contrary, stretching of the cable causing the cable to be tensioned with a consequent reduction in its thickness) is due to the manner in which said cable (and also the wire produced) is unwound from the corresponding support (spool or bobbin). In fact, when the wire or cable unwinds freely from the corresponding support and moves away from it without being immediately guided towards a feeder (which draws it from that support) such wire or cable creates a "balloon effect" around the support, an effect which increases as emptying of the spool or bobbin of wire proceeds. Balloon unwinding can occur in an anticlockwise direction in a plane at right angles to the axis of the spool and depending upon the direction of rotation this may result in increased "twist" in the braid or its loosening with consequent "loosening" or "unravelling" of the cable.

This problem has been found in systems feeding braided copper wire electrical cable to a winding machine where the cable spool is located relatively distantly from the feed device sending the cable to the operating machine, and where its axis is at right angles to a rotating pick-up member of such device.

In such a relative arrangement the cable drawn from the spool creates a "balloon" effect around it. It is found that, as mentioned, the cable may be stretched or relaxed, depending upon the direction of rotation of the cable about the axis of the spool, giving rise to loosening of the braid.

In the context of the feeding of a metal cable comprising several braided wires, the problem of loosening of the cable being unwound from a spool, associated with contact between it and guide means to an operating machine or different support or spool is also known. This problem has for example been solved in patent U.S. Pat. No. 3,502,828 through a feed system provided with a complex device which intervenes actively (that is, acting upon it) while the wire is being fed to a winding spool, something which on the one hand makes the aforesaid system difficult and costly to implement and on the other increases its size, and from another point of view can make it more difficult to hold the cable tension (or other cable property) constant.

Now that the above-mentioned problem has been identified, the object of the present invention is therefore to provide a method and system to resolve the problem simply, without affecting properties of the wire such as its tension or velocity.

These and other objects which will be apparent to those skilled in the art will be accomplished through a method and system according to the corresponding independent claims.

BRIEF DESCRIPTION OF THE DRAWINGS

For a better understanding of this invention the following drawings are appended purely by way of non-limiting example, in which.

DETAILED DESCRIPTION OF THE PREFERRED EMBODIMENTS

Figure 1:
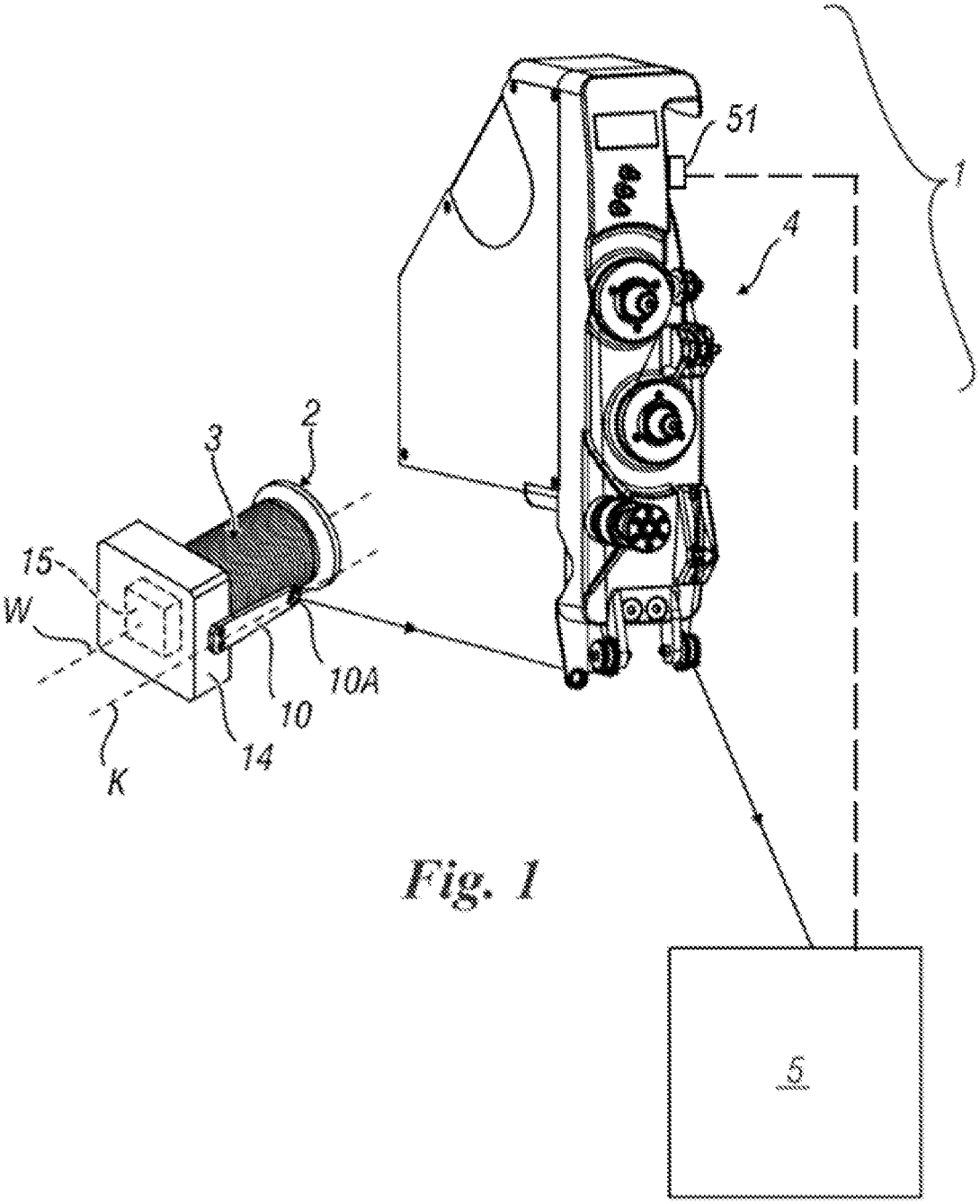
FIG. 1 shows a diagrammatical view of a first system according to the invention.

With reference to the above-mentioned figures, the present invention mainly relates to the fact that it has been found that structural change in a multistrand metal cable (that is one comprising a plurality of braided individual wires) or flat cable drawn from a corresponding support (for example, a spool) happens because of the manner in which that cable or wire is unwound from the corresponding support. The object of the invention is therefore to define a manner of unwinding and a system such that the problem indicated above can be overcome.

According to the invention a system 1 comprises a support or spool 2 supporting a multistrand metal cable 3. This cable 3 is drawn from spool 2 and passes through an intermediate device 4 located between the cable spool 2 and an operating machine 5 such as, for example, a winding machine (or winder) 5 or a textile machine 5.

Device 4 may be of the type such as to feed the cable to machine 5 independently or may be a mere tensioning device capable of creating a particular desired set tension in cable 3. In the first case device 4 is for example of the type described in WO2013/064879 in the name of the Applicant, and acts actively to draw cable 3 from spool 2 and feed it to machine 5; conversely, in the second case, the wire is drawn off through other known means (not shown) which feed it to a machine 5, and device 4 is a tensioner or a braking device which can bring about an increase in the tension of the cable downstream from device 4 itself.

In the first case the device (feeder 4) delivers cable 3 to the operating machine, maintaining at least one property of the cable (selected from its tension, feed velocity and quantity fed) equal to at least one predefined pre-set (constant) value.

In a manner of feeding which is not the subject of the method according to the invention, cable (or flat wire) 3 is unwound from spool or support 2 in a controlled way tangentially to the spool itself (or better, tangentially to the mass of cable 3 wound on the spool) with respect to the W axis of support 2. The latter may be fixed or rotate about such axis.

In other words, cable 3 is unwound from spool 2 in a direction at right angles to that axis. It is known that the term "at right angles" comprises both unwinding at a right angle with respect to such axis, but also unwinding inclined at ±45° with respect to the W axis. Furthermore, by unwinding in a "controlled way" is meant that cable 3 does not detach from the spool forming a balloon around it (that is in an "uncontrolled" way), a balloon which expands as the spool is emptied. On the contrary, the cable detaches from the spool already under tension, without any movement around the W axis mentioned above. This means that cable 3 does not move in a way which might vary its structure (as indicated above), but maintains the structure, being unable to rotate in a direction opposite to that of the braid of individual wires or in the direction of the braid.

Figure 2:
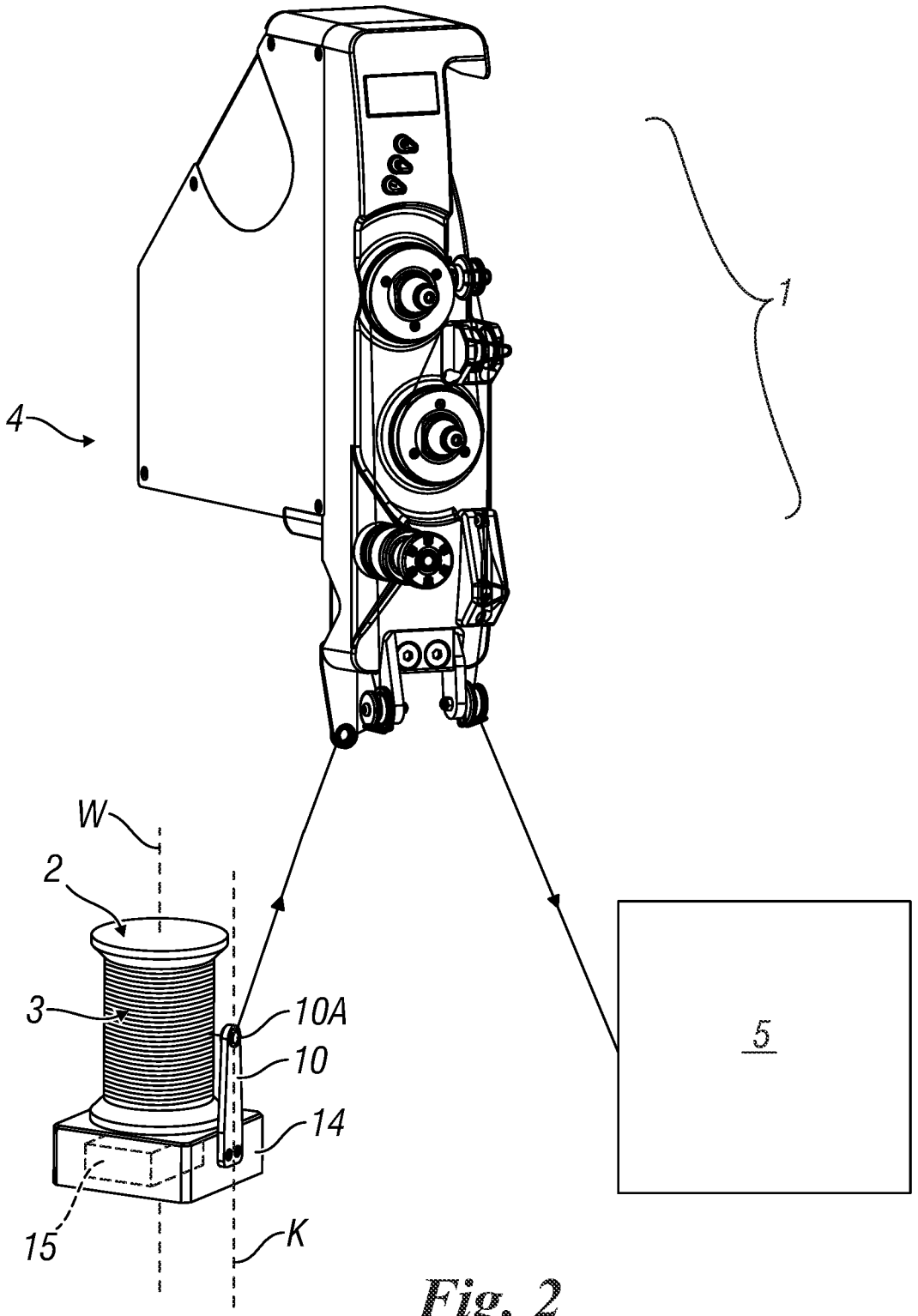
FIG. 2 shows a diagrammatical view of a second system according to the invention.
Figure 3:
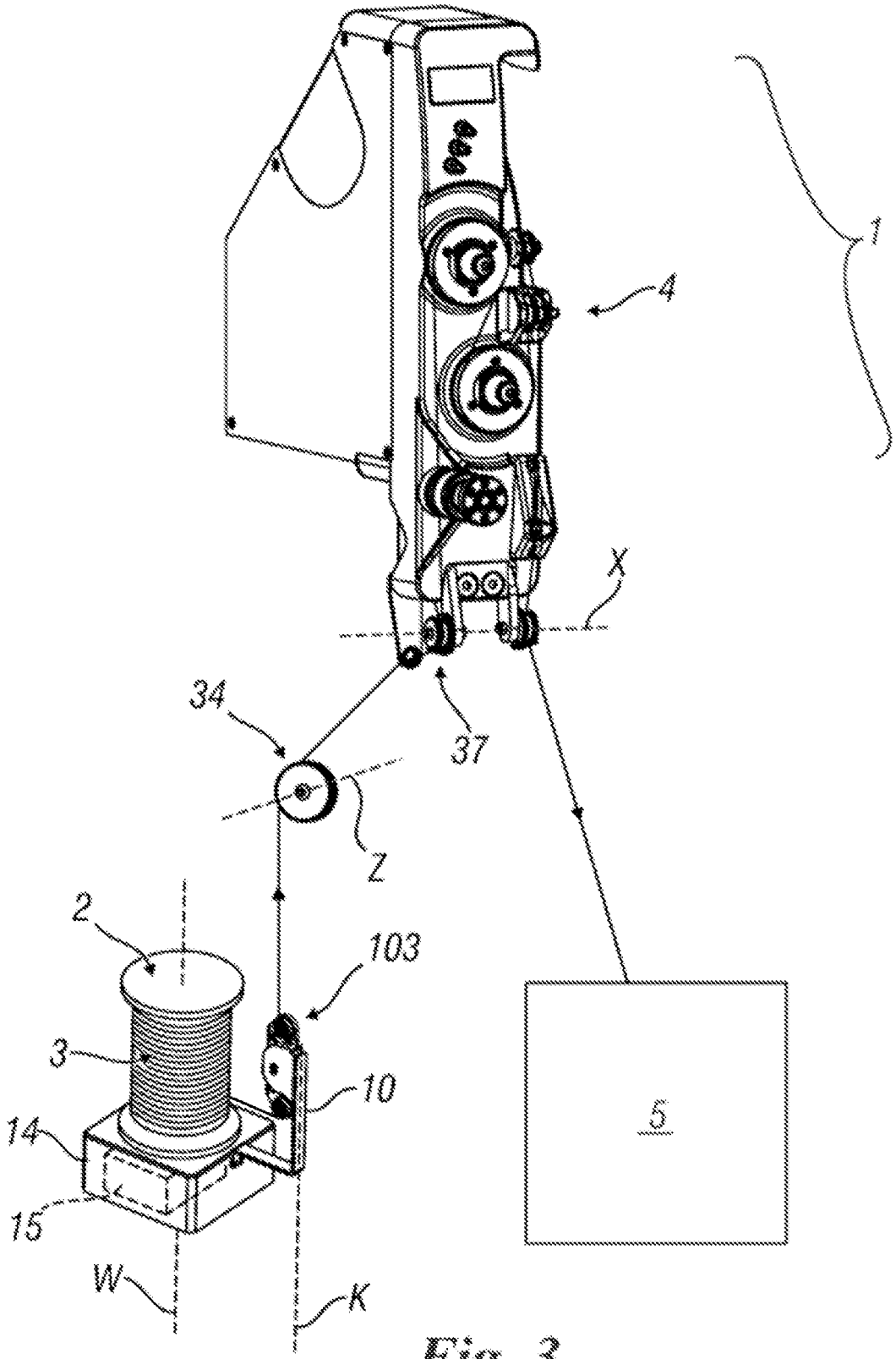
FIG. 3 shows a diagrammatical view of a third system according to the invention.
Figure 4:
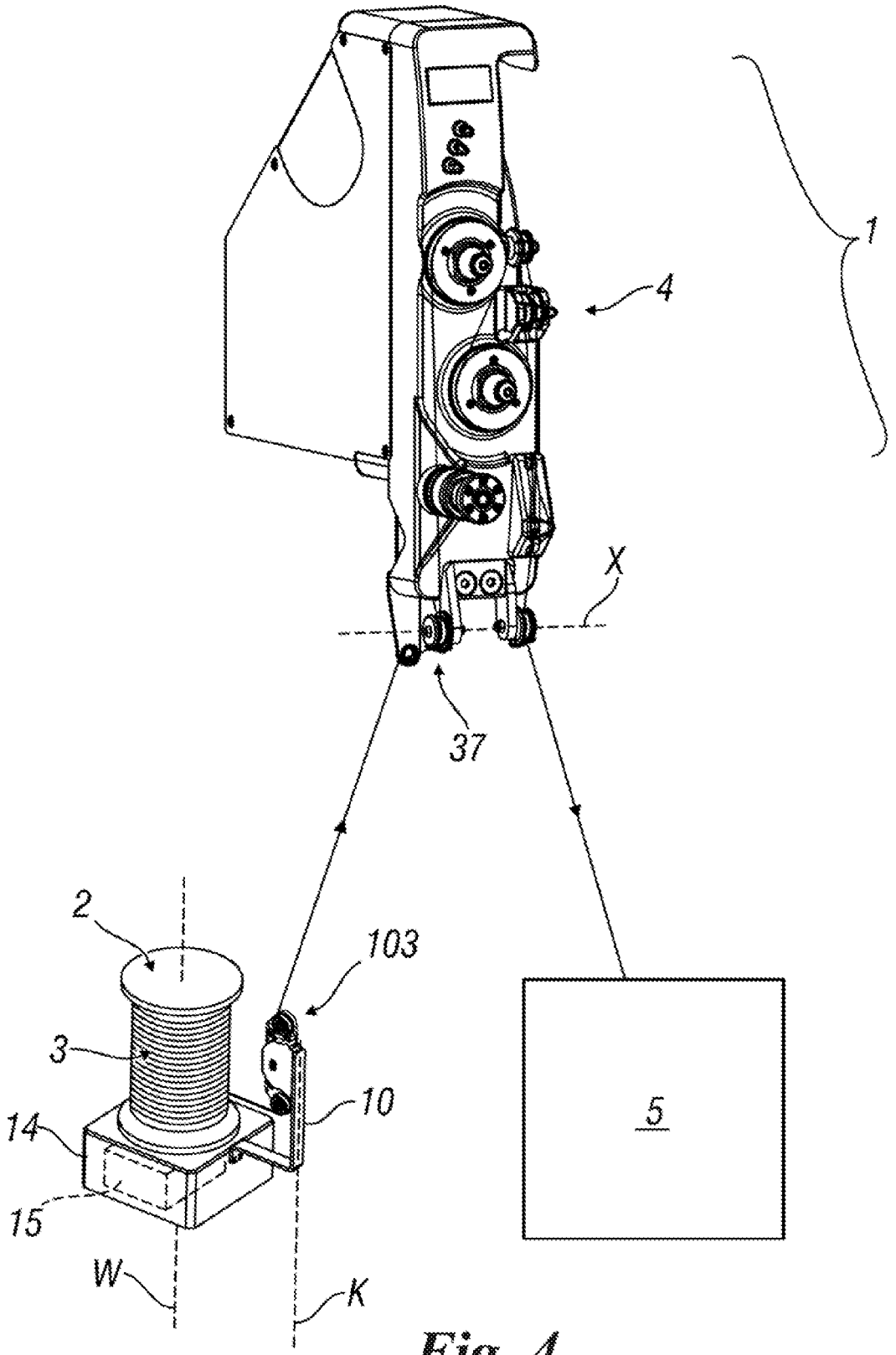
FIG. 4 shows a diagrammatical view of a fourth system according to the invention.

According to one embodiment of the invention (shown in the figures), the cable (or flat wire) is unwound from the spool in an uncontrolled way, but subsequently passes over a return member 10 (or better, within an eye 10A of such return member, as shown in FIGS. 1-3) located at a short distance from spool 2 positioned with axis K parallel to the latter's W axis. In this way the ballooning movement of the wire is immediately stopped without having any effects on the structure; after return member 10, the wire moves at right angles to the W axis of the spool, which means that it avoids stretching or "separation" of the braided wires. Member 10 is associated with supporting body or member 14 which also supports spool 2 and, for this reason, is located at a short distance from the latter.

Advantageously, the system provides that spool 2 is supported by supporting member 14 and driven by its own electric motor 15 (contained within support 14) which is activated in such a way that said spool 2 can rotate at a controlled speed, encouraging release of cable 3 in the manner indicated above. This avoids the cable altering its structure (stretching or creating whiskers) or the flat wire from forming a helix.

The solution envisaged in the present invention is of the passive type in that it does not actively act on the wire feed, neither is it implemented so as to detect a specific property or shape or change in the structure or shape of delivered cable 3.

Arm 10 receives such cable passing through its eye 10A, and only because of the fact that it is located at a short distance from spool 2 is it able to maintain the structure of said cable with certainty, in that it avoids the ballooning effect of the cable about such spool, an effect which, as mentioned, is the cause of a change in the structure of the delivered cable.

In addition to this, the system can operate in one of the following ways. In a first way it is provided that wire feed/tensioner device 4 sends information relating to the feed velocity of wire or cable 3 to the operating machine 5 via a suitable communication bus 51 (configured to transmit a signal), acting so that such wire or cable always remains tensioned upstream from the feed device, avoiding loosening or tearing during the stage when the feed/tensioner device is decelerating and accelerating.

In a second way feed/tensioner device 4 for wire or cable 3 controls the braking torque applied to electric motor 15 so as always to rotate spool 2 in such a way as to prevent tearing/loosening during the stages in which the wire fed to the process accelerates or decelerates.

Figure 5:
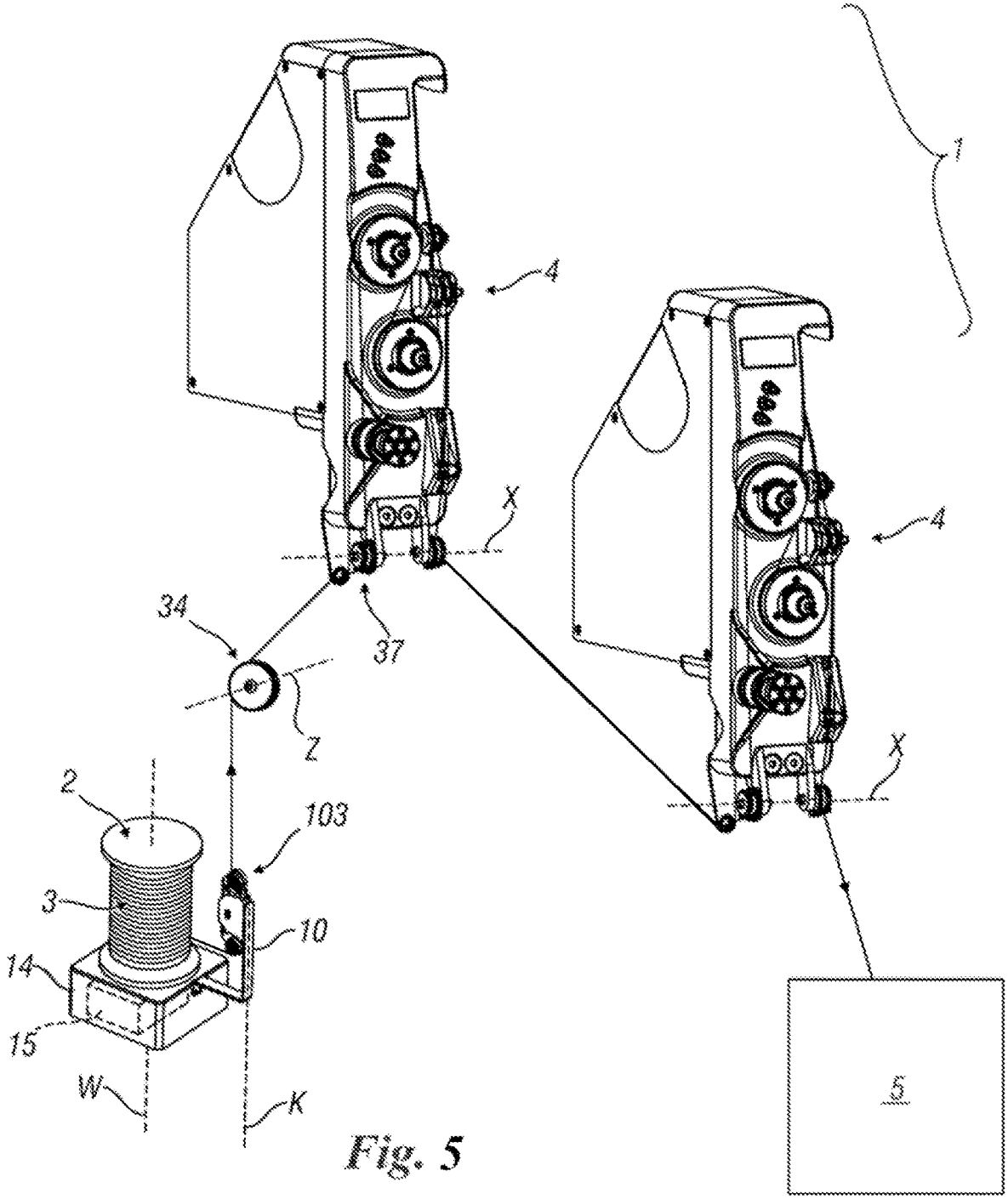
FIG. 5 shows a diagrammatical view of a system feeding the wire upstream of a second feed/tensioner device.

In a third configuration, provision is made for a sensor 34 (e.g., a tension sensor, a velocity sensor, or a combined tension and velocity sensor) located between spool 2 and feed/tensioner device 4, so that wire or cable 3 does not undergo any loosening or extra tensioning as it runs out respectively during the stages in which the wire or cable fed to the process is slowed/accelerated. In this case, device 4 may operate either independently, feeding the wire to machine 5 directly, or feeding it upstream of a second feed/tensioner device 4 (FIG. 5), synchronously therewith, through exchanging information on the wire's or cable's velocity and/or torque and/or feed tension to the production process performed by machine 5.

Therefore, according to the invention, cable or wire 3 is unwound from support or spool 2 and immediately acts together with arm 10 in a way such that it does not change its structure (or, as mentioned, being stretched or giving rise to loosened whiskers, or taking up a helical shape in space) at least from the time when one of its properties (tension, velocity, quantity delivered) is measured until operating machine 5 processes it. Preferably, with this property being held constant from the time that cable 3 is unwound from spool 2, the structure of such cable or flat wire remains unchanged from the time that it is unwound from the spool to textile machine 5.

In addition, cable (or wire) 3 is fed to machine 5 with at least one of its properties held constant, that is its tension and/or velocity (but also the quantity of wire delivered), and this ultimately makes it possible for cable 3 to be drawn off from spool 2 in such a way that its structure is not altered. In fact, for example, by keeping the cable or wire tensioned or feeding it to machine 5 without tearing, cable 3 or the flat wire is always unwound from support or spool 2 in such a way that the direction in which the wire is drawn off is always at right angles to the W axis of the spool, because of the presence of member 10.

One embodiment of the invention has been described. Others are yet possible in the light of the above, such as that in which return member 10 (also acting as a wire guide) may comprise a tension sensor 103 (FIG. 3) connected to feed device 4 so that the latter can have more data to control the drawing-off of cable or wire 3 from spool 2.

Thanks to the system according to the invention, the problem associated with the changes in the structure of cable or wire 3 described above is overcome.

The invention claimed is:

1. A method for feeding a metal cable twisted and braided into a plurality of braids or a flat wire from a spool to an operating machine which processes the cable or wire, said feeding comprising unwinding the cable or wire from the spool, wherein the spool is supported by a supporting member, wherein the spool has a longitudinal axis aligned with the supporting member, measuring at least one monitored property of the cable or wire from among its tension, velocity and quantity delivered, sending information related to the feed velocity of the wire or cable to the operating machine via a communication bus, any adjustment of the property and feeding of the cable or wire to the operating machine with the aforesaid property being held constant, the cable or wire being unwound in a controlled way in a direction at right angles to the longitudinal axis of the spool, wherein the controlled unwinding takes place by unwinding the cable or wire from the spool in an uncontrolled way but subsequently passing the cable or wire leaving the spool over a return member located at a short distance from such spool and associated with the supporting member for the spool to immediately stop ballooning movement of the cable or wire, wherein the spool is driven in rotation in an unwinding direction about its own longitudinal axis by its own electric motor associated with said supporting member, said driving being obtained at a velocity such as to maintain the unwinding of the cable or wire at right angles to the axis of the spool, this controlled unwinding preventing the cable from changing its structure through loosening or stretching or preventing said wire from suffering twisting before its property is measured, said cable or said wire maintaining its own structure from spool to the operating machine.

2. The method according to claim 1, further comprising a sensor for measuring the monitored property of the cable or wire that is directly on said return member.

3. The method according to claim 1, wherein the return member extends from the supporting member, wherein the controlled unwinding takes place by passing the cable leaving the spool over a portion of the return member positioned with an axis parallel to the axis of the spool.

4. The method according to claim 3, wherein the at least one monitored property of the cable or wire is monitored by a device feeding the cable or wire located between the spool and the operating machine, said feed device controlling a braking torque applied to the electric motor rotating said spool.

5. The method according to claim 3, wherein the electric motor is within the supporting element.

6. The method according to claim 1, wherein the cable or wire unwinds from the spool with the controlled property being held constant during said unwinding.

7. The method according to claim 1, wherein the at least one monitored property of the cable or wire is monitored by a tensioning member located between said spool and the operating machine.

8. The method according to claim 1, wherein the at least one monitored property of the cable or wire is monitored by a tension and/or velocity sensor member close to the spool.

9. The method according to claim 1, wherein the cable or wire is unwound from the spool and subsequently passes within an eye of the return member within the portion of the return member positioned with an axis parallel to the axis of said spool.

10. The method according to claim 1, wherein the controlled unwinding takes place by passing the cable leaving the spool from the spool to directly over the return member located at the short distance from such spool and associated with the supporting member for the spool.

11. A system for feeding a twisted braided metal cable or a flat wire to an operating machine which processes it, said system implementing the method according to claim 1 and comprising a spool for such cable or wire, a supporting member to support the spool, wherein the spool has a longitudinal axis aligned with the supporting member, means to measure at least one monitored property of the cable or wire from among its tension, its feed velocity or quantity of wire delivered, means to provide monitoring of any measured property and for feeding said cable or wire to said machine holding said at least one property at a constant value, the cable or wire detaching itself at right angles from such spool with reference to the longitudinal axis of said spool, wherein a return member for the cable or wire is provided close to the spool which controls detachment of the wire from such spool at right angles by passing the cable leaving the spool over the return member located close to the spool, said return member being associated with the supporting member for said spool, said cable or wire having the braided structure or flat conformation which remains unchanged at least from such time as its property is measured as far as the operating machine adapted and configured such that the cable or wire is unwound in a controlled way in a direction at right angles to the longitudinal axis of the spool, wherein the controlled unwinding takes place by unwinding the cable or wire from the spool in an uncontrolled way but subsequently passing the cable or wire leaving the spool over a return member located at a short distance from such spool and associated with the supporting member for the spool to immediately stop ballooning movement of the cable or wire, and adapted and configured such that said spool is driven by its own electric motor associated with the supporting member for the return member, said spool being driven in rotation in an unwinding direction about its own longitudinal axis by such electric motor at a constant velocity.

12. The system according to claim 11, wherein the metal cable or the flat wire has an unchanged structure from the spool from which it is unwound, to the operating machine.

13. The system according to claim 11, wherein the return member extends from the supporting member, wherein the cable leaving the spool passes over a portion of the return member positioned with an axis parallel to the axis of said spool.

14. The system according to claim 13, wherein the means for measuring the monitored property are a feed device for the cable or wire to the operating machine, said feed device applying a braking torque to the electric motor rotating said spool.

15. The system according to claim 14, comprising the feed device, wherein the communication bus connects such feed device to the operating machine so that information relating to the feed velocity of the wire or cable to that machine can be used to maintain said cable or wire at a desired tension upstream of the feed device itself.

16. The system according to claim 14, comprising a feed device, further comprising a second feed/tensioner device operating synchronously with the first feed device.

17. The system according to claim 11, wherein the means for measuring the monitored property is a tension sensor member close to the spool.

18. The system according to claim 11, wherein said return member comprises a tension sensor.

19. The system according to claim 11, wherein the return member has an eye for passing the cable or wire unwound from the spool within the eye.

20. The system according to claim 11, adapted and configured for the cable leaving the spool to pass from the spool directly to the return member.

* * * * *